US005992460A

United States Patent [19]

Akimoto

[11] Patent Number: 5,992,460

[45] Date of Patent: Nov. 30, 1999

[54] SOLENOID-CONTROLLED PILOT-OPERATED THREE-POSITION SWITCHING VALVE

[75] Inventor: Takashi Akimoto, Tsukuba-gun, Japan

[73] Assignee: SMC Corporation, Tokyo, Japan

[21] Appl. No.: 09/195,683

[22] Filed: Nov. 19, 1998

[30] Foreign Application Priority Data

Dec. 16, 1997 [JP] Japan ..... 9-363599

[51] Int. Cl.[6] ..... F15B 13/043

[52] U.S. Cl. ..... 137/625.64; 137/625.66

[58] Field of Search ..... 137/625.64, 625.66

[56] References Cited

U.S. PATENT DOCUMENTS 3,267,965 8/1966 Kroffke ..... 137/625.66 X
4,267,862 5/1981 Neff et al. ..... 137/625.64

FOREIGN PATENT DOCUMENTS 59-190586 10/1984 Japan .

*Primary Examiner*—Gerald A. Michalsky
*Attorney, Agent, or Firm*—Oblon, Spivak, McClelland, Maier & Neustadt, P.C.

[57] ABSTRACT

A three-position switching valve has a spool positioned in a valve hole that is moved relative to two drive chambers positioned on either end of the valve hole. Solenoid-controlled pilot valves are provided to control supplying and ejecting a pilot fluid to and from the two respective drive chambers. This spool is held at a neutral position by the provision of two piston chambers being formed adjacent to each of the drive chambers and constantly receiving pilot fluid through a channel, the piston chambers each having a smaller diameter than that of the drive chambers. Each piston chamber accommodates a piston which may slidably move so as to be urged by pilot fluid toward the spool and a linking member interposed between each of the pistons and the spool. A return spring is interposed between each of the pistons and each linking member as part of the structure holding the spools at the neutral position.

7 Claims, 3 Drawing Sheets

SOLENOID-CONTROLLED PILOT-OPERATED THREE-POSITION SWITCHING VALVE

FIELD OF THE INVENTION

The present invention relates to a solenoid-controlled pilot-operated three-position switching valve that uses a solenoid-operated pilot valve to switch a spool among three positions.

PRIOR ART

A conventional three-position switching valve is generally configured as a spring-center type that uses a return spring to hold a spool at a neutral position. As schematically shown in FIG. 4, return springs 3*a* and 3*b* are compressed in drive chambers 2*a* and 2*b* at the respective ends of a spool 1 so that when the spool 1 not driven, the return springs 3*a* and 3*b* hold the spool 1 at a neutral position. When a pilot valve 4 alternatively supplies and ejects a pilot fluid to and from the two drive chambers 2*a* and 2*b,* the spool 1 is switched in the lateral direction, as seen in the figure, while compressing the return spring in the drive chamber on the ejection side.

As described above, the conventional three-position switching valve is configured to hold the spool at a neutral position using the return springs on the respective sides. Thus, whenever the spool is switched, one of the return springs is compressed to cause the compressive force to act as a reaction force. Accordingly, in order to reliably switch the spool against the reaction force from the compressed return spring, a pilot fluid of a correspondingly high pressure must be supplied, thereby increasing the minimum operational pressure of the spool, which results in reducing the working pressure range of the fluid. In addition, the reaction force of the return spring increases as the amount of compression associated with the switching operation of the spool increases, so the switching operation is likely to become unstable.

Although use of return springs having weaker urging force allows the use of a pilot fluid of a correspondingly lower pressure, a weaker urging force allows the spool to be affected more easily by the operating or pilot fluids, causing the spool's return and neutral-maintenance operations to become unstable.

DISCLOSURE OF THE INVENTION

It is an object of this invention to provide a solenoid-controlled pilot-operated three-position switching valve wherein while a pressure fluid within a working pressure range is being supplied, a working force effected by pilot-fluid pressure holds a spool at a neutral position, so that the spool can be switched without being affected by the reaction force from any return springs.

To achieve this object, this invention provides a three-position switching valve comprising a drive chamber to and from which a pilot fluid is supplied and ejected to drive a spool, and a piston chamber that has a smaller diameter than the drive chamber and into which a pilot fluid is constantly introduced, both chambers being provided mutually adjacent at both ends of a valve hole in which a spool is accommodated, wherein a linking member is interposed between the spool and a piston accommodated in the piston chamber and wherein a return spring having a weak urging force is interposed between the linking member and the piston. The urging force of the return spring is set to be lower than or equal to the force effected by the pilot-fluid pressure to drive the piston.

According to the present three-position switching valve of this configuration, while a pressure fluid is being supplied to the switching valve, the working force of a pilot fluid constantly introduced into the piston chamber presses the piston toward the linking member to compress the return spring having a weak urging force. The piston then abuts the linking member and presses the spool from both sides via the linking member, thereby holding the spool at its neutral position. Then, the return spring is completely compressed and is not involved in the operation to hold the spool at the neutral position, so the spool is held at this position only by the working force of the pilot fluid.

When a pilot fluid is supplied to one of the drive chambers through the pilot valve, since the drive chamber has a larger diameter than the piston chamber and since the working force of the pilot fluid acting on the spool on this drive chamber side is stronger than the working force of the piston on the opposite side, the spool moves in one direction while moving the piston backward via the linking member to switch channels. In this case, the piston moved backward by the spool remains in contact with the linking member, preventing the urging force of the return spring interposed between the piston and the linking member from acting as a reaction force against the spool.

When the pilot fluid is ejected from the drive chamber, the working force of the piston, which has been moved backward, causes the spool to return to the neutral position.

While no pressure fluid is being supplied to the switching valve or while a pressure fluid is being supplied below the working pressure, the urging force of the return spring causes each piston to move backward from the linking member to the opposite end of the piston chamber while causing the spool to be held at the neutral position.

According to a specific embodiment of this invention, each drive chamber is formed at that position at each end of the valve hole which is faced by the end surface of the spool acting as a pressure-receiving surface, and each piston chamber is formed outside the drive chamber via a partition wall acting like a cushion. The linking member is disposed to penetrate the partition wall in such a way that its ends protrude into the piston and drive chambers, respectively, and a flange section is formed at the piston-chamber-side end of the linking member in such a way as to abut the partition wall, so that when the linking member is pressed by the piston, the flange section abuts the partition wall to hold the spool at the neutral position.

According to this invention, a guide shaft and a guide hole that are fitted together are provided in the piston and the linking member, respectively, as a guide means for stabilizing the piston's sliding action.

The switching valve according to this invention may have in its valve body an external pilot port for introducing a pilot fluid into a valve body from the exterior, so that a pilot channel switching means can selectively connect the external pilot port or a supply port to the drive and piston chambers.

In this case, the pilot channel switching means is composed of a switching plate mounted on a mounting surface of the valve body so as to have its direction changed, three channels opened in the mounting surface in a row, and a dent formed in the switching plate to connect the middle channel to one of the two side channels when the direction of the switching plate is changed. The middle channel acts as a pilot supply channel leading to the drive and piston chambers, one of the side channels acts as an internal pilot channel leading to the supply port, and the other side channel acts as an external pilot channel leading to the external pilot port.

DETAILED DESCRIPTION

Figure 1:
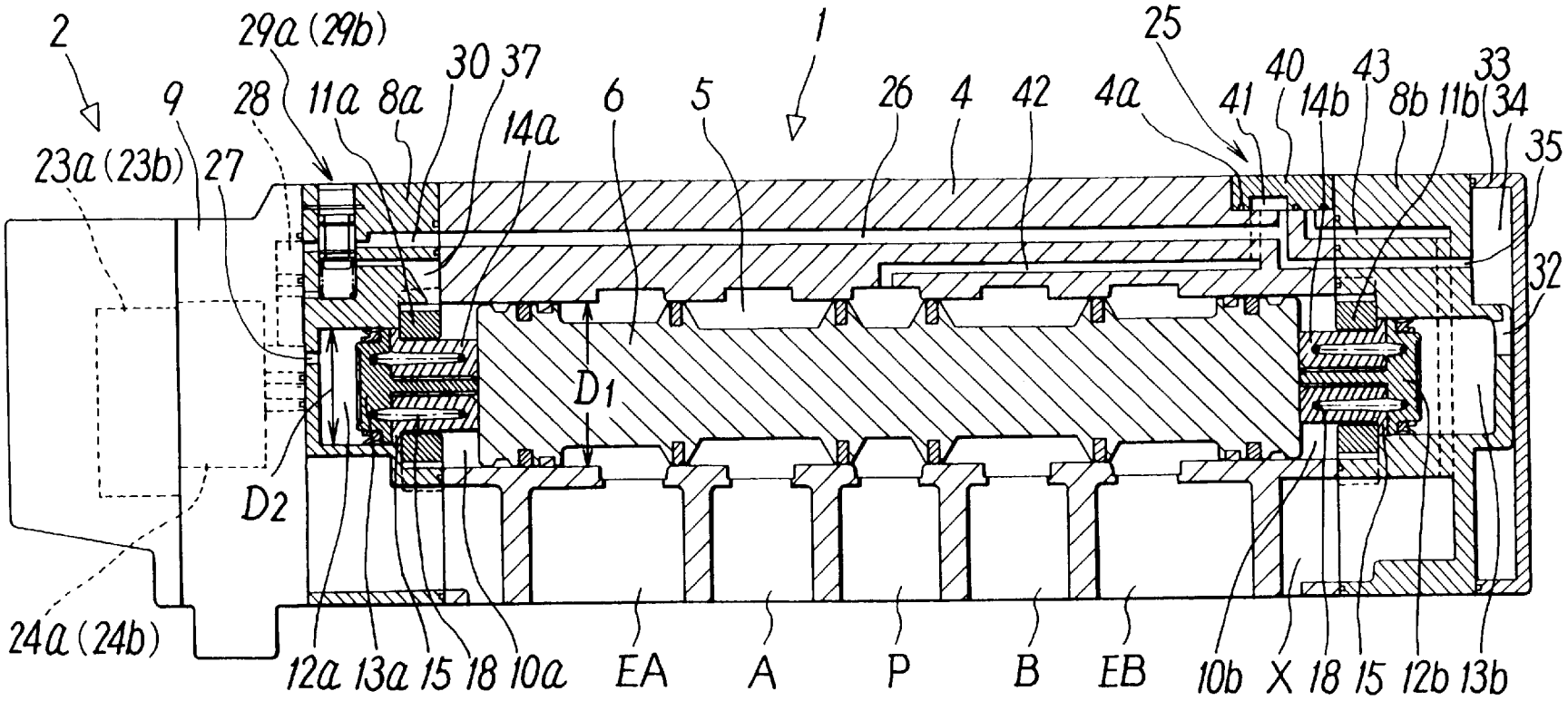
FIG. 1 is a sectional view of the integral part of one embodiment of a three-position switching valve according to this invention.

FIG. 1 shows as a five-port valve which is one embodiment of a solenoid-controlled pilot-operated three-position switching valve according to this invention. This switching valve includes a main valve section 1 for switching an operating fluid such as compressed air and a pilot valve section 2 for operating the main valve section 1.

The main valve section 1 has a valve body 4 having a rectangular cross section. The valve body 4 has in its bottom surface one supply port P through which an operating fluid flows, two output ports A and B opened on the respective sides of the supply port, and two ejection ports EA and EB opened on the respective sides of the output ports. The valve body 4 has formed inside a valve hole 5 with which each of these ports is in communication, and a spool 6 is slidably accommodated in the valve hole 5 to switch a channel between the ports.

A first and a second drive chambers 10*a* and 10*b* are formed at the respective ends of the valve hole 5 in the axial direction between the valve hole and a sub-block 8*a* or 8*b* mounted on the corresponding end of the valve body 4 in such a way that the drive chamber is faced by the end surface of the spool 6 acting as a pressure receiving surface. In addition, a first and a second piston chambers 12*a* and 12*b* located adjacent to the drive chambers 10*a* and 10*b*, respectively, via partition walls 11*a* and 11*b* that act like cushions are formed inside the sub-blocks 8*a* and 8*b*, respectively. A first and a second pistons 13*a* and 13*b* are slidably accommodated in the piston chambers 12*a* and 12*b*, respectively.

The diameter D, of the drive chambers 10*a* and 10*b* is larger than the diameter $D_2$ of the piston chambers 12*a* and 12*b*, while the two drive chambers 10*a* and 10*b* have the same diameter, as do the piston chambers 12*a* and 12*b*. However, the diameters of the drive chambers 10*a* and 10*b* need not necessarily be the same, nor do those of the piston chambers 12*a* and 12*b*.

Cylindrical linking members 14*a* and 14*b* are disposed between the spool 6 and the pistons 13*a* and 13*b*, respectively, to cooperate with the pistons 13*a* and 13*b* in holding the spool 6 at the neutral position, in such a way that the linking members can move and penetrate the partition walls 11*a* and 11*b*, respectively. Each linking member 14*a* and 14*b* has a flange section 15 at the end of its side where the member protrudes into the piston chamber 12*a* or 12*b*, so that the flange section 15 is pressed by the piston 13*a* or 13*b* and moved toward the spool 6 until it abuts the partition wall 11*a* or 11*b*, where the tip of the linking member protruding into the drive chamber 10*a* or 10*b* abuts the spool 6 to hold it at the neutral position.

A return spring 18 having a weak urging force is compressed between the piston 13*a* or 13*b* and the linking member 14*a* or 14*b*. The urging force of the return spring 18 is set lower than or equal to the working force of the piston 13*a* or 13*b* effected by a pilot-fluid pressure that falls within a working pressure range. Thus, while a pilot fluid is acting on the piston 13*a* or 13*b*, the return spring 18 is completely compressed to allow the piston 13*a* or 13*b* to abut the linking member 14*a* or 14*b*, thereby pressing the linking member 14*a* or 14*b* against the partition wall 11*a* or 11*b*, as shown in FIG. 1.

Figure 3:
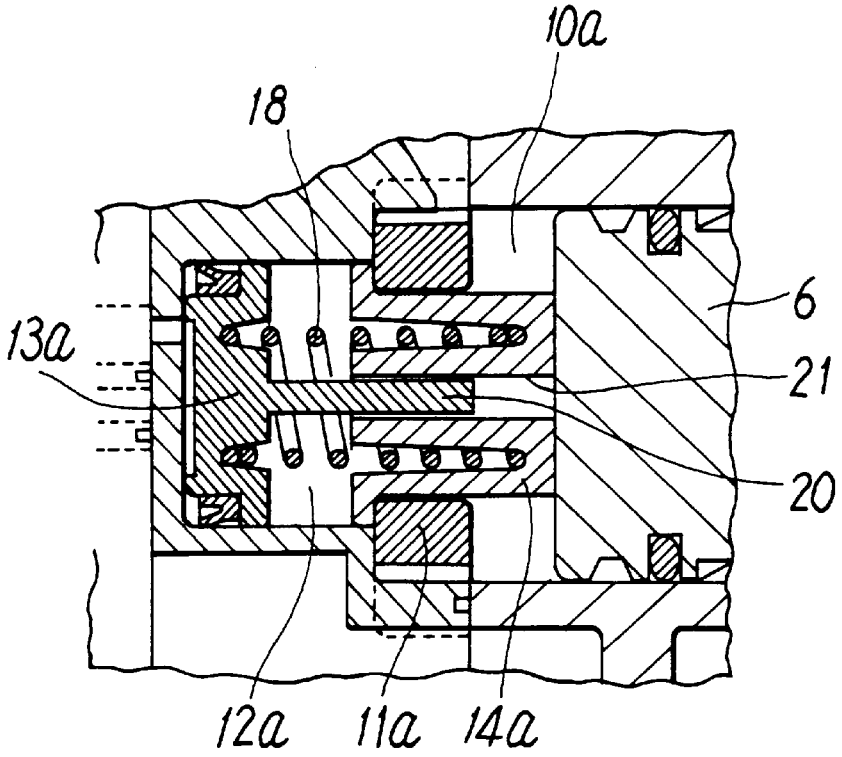
FIG. 3 is a sectional view showing a yet different operational position of the three-position switching valve in FIG. 1.

On the other hand, when the switching valve is not used and while no pilot fluid is being supplied to the piston 13*a* or 13*b*, or while a pilot fluid is being supplied below the working pressure, the urging force of the return spring 18 causes the piston 13*a* or 13*b* to move backward from the linking member 14*a* or 14*b*, respectively, to the opposite end of the piston chamber 12*a* or 12*b*, while causing the spool 6 to be held at the neutral position, as shown in FIG. 3.

To stabilize the movement of the piston 13*a* or 13*b*, a guide means is arranged in the piston 13*a* or 13*b* and the linking member 14*a* or 14*b* and consists of a guide shaft 20 formed on the piston 13*a* or 13*b*; and a guide hole 21 that is formed in the linking member 14*a* or 14*b* and in which the guide shaft 20 is slidably fitted, as shown in FIG. 3.

A pilot fluid is individually supplied to and ejected from the two drive chambers 10*a* and 10*b* through two solenoid-controlled pilot valves 23*a* and 23*b* provided in the pilot valve section 2. At the same time, a pilot fluid is constantly introduced into the two piston chambers 12*a* and 12*b*. The specific configuration of these components is shown below.

The valve body 4 has formed therein a pilot supply channel 26 that can be selectively connected to the supply port P or the external pilot port X by the pilot channel switching means 25. The pilot supply channel 26 is constantly in communication with the first piston chamber 12*a* through a through-hole 27 provided in the sub-block 8*a*, a through-hole 28 provided in a pilot block 9, and a manual operation mechanism 29*a* and a through-hole 30 provided in the sub-block 8*b*. The pilot supply channel 26 is also constantly in communication with the second piston chamber 12*b* through a through-hole 32 provided in the sub-block 8*b*, a channel 34 between the sub-block 8*b* and an end cover 33, and a through-hole 35 provided in the sub-block 8*b*.

Of the two drive chambers 10*a* and 10*b*, the first drive chamber 10*a* is in communication with the pilot supply channel 26 through a through-hole 37 formed in the sub-block 8*a* via the manual operation mechanism 29*a* and the pilot valve 23*a*. The second drive chamber 10*b* is in communication with the pilot supply channel 26 through a through-hole (not shown) formed in the valve body 4 via another manual operation mechanism 29*b* provided parallel to the manual operation mechanism 29*a* and another pilot valve 23*b* provided parallel to the pilot valve 23*a*. The pilot valves 23*a* and 23*b* corresponding to the drive chambers 10*a* and 10*b* are turned on and off, or the manual operation mechanisms 29*a* and 29*b* are pressed to supply or eject a pilot fluid to or from the drive chamber 10*a* and 10*b*.

Amplifying valves 24*a* and 24*b* are desirably interposed between the two pilot valves 23*a* and 23*b* and drive chamber 10*a* or 10*b*, respectively, so that pilot valves of a small capacity enable a large flow of pilot fluid to be supplied to the drive chambers. The configurations of the pilot and amplifying valves do not directly relate to the subject of this invention, so a detailed description of these components is omitted.

The manual operation mechanisms 29*a* and 29*b* are manually operated to allow the pilot supply channel 26 to directly communicate with the drive chambers 10*a* and 10*b*, respectively, without passing through the pilot valve 23*a* or 23*b*. The manual operation mechanisms 29*a* and 29*b* are well known and their configuration does not directly relate to the subject of this invention, so their detailed description is omitted.

The pilot channel switching means changes the switching valve between the internal and external pilot types, and includes a switching plate 40 mounted on a mounting surface 4*a* formed on the valve body 4 in such a manner that the direction of the plate can be changed. A dent 41 constituting a channel is formed in the inner surface of the switching plate 40 in such a way as to be biased to one side of the plate. The mounting surface 4*a* has the pilot supply channel 26 opened at its center, and on the respective sides of the pilot supply channel 26, an internal pilot channel 42 leading to the supply port P and an external pilot channel 43 leading to the external pilot port X are opened.

If the switching plate 40 is mounted in the direction shown in FIG. 1, the dent 41 allows the pilot supply channel 26 to communicate with the internal pilot channel 42, so the switching valve acts as the internal pilot type to cause part of an operating fluid to be diverted through the supply port P, where it functions as a pilot fluid. In addition, if the switching plate 40 is laterally inverted, the dent 41 allows the pilot supply channel 26 to communicate with the external pilot channel 43, so the switching valve acts as the external pilot type to cause an exclusive pilot fluid separate from the operating fluid to be supplied through the external pilot port X.

According to a three-position switching valve of this configuration, while no operating fluid is being supplied to the switching valve or while a operating fluid is being supplied below the working pressure, the urging force of the return spring 18 causes each piston 13*a* or 13*b* to move backward from the linking member 14*a* or 14*b*, respectively, to the opposite end of the piston chamber 12*a* or 12*b*, respectively, while causing the spool 6 to be held at the neutral position, as shown in FIG. 3.

Figure 4:
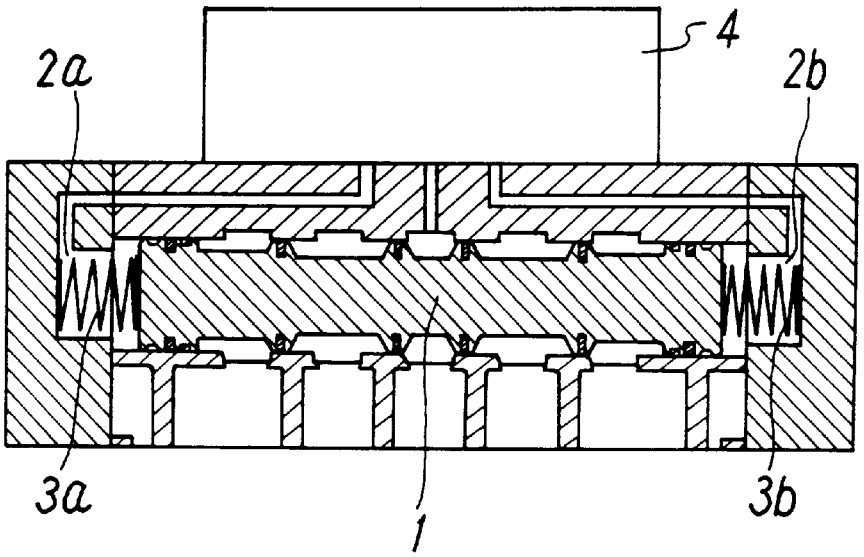
FIG. 4 is a sectional view schematically showing a conventional three-position switching valve.

When an operating fluid at a pressure within a working pressure range is supplied to the switching valve, a pilot fluid is constantly introduced into the piston chamber 12*a* or 12*b* to press the piston 13*a* or 13*b* toward the linking member 14*a* or 14*b*, respectively, as shown in FIG. 4. The piston 13*a* or 13*b* compresses the return spring 18 having a weak urging force to move the linking member 14*a* or 14*b* until the flange section 15 abuts the partition wall 11*a* or 11*b*, respectively, thereby holding the spool 6 at the neutral position. Then, the return spring 18 is completely compressed and its urging force is not involved in the operation to hold the spool 6 at the neutral position. Thus, the spool 6 can be held at this position only by the pressure of the pilot fluid, despite the presence of the return spring 18.

Figure 2:
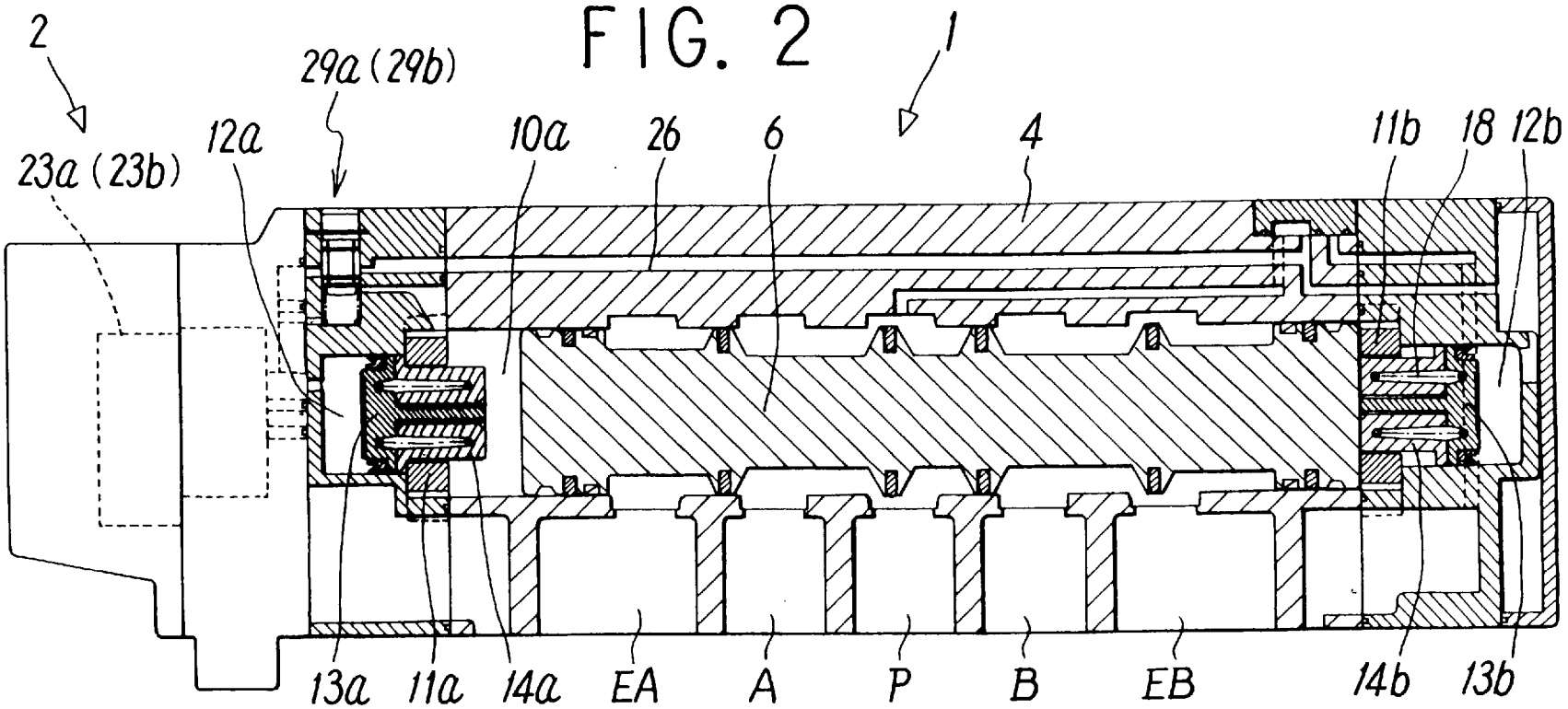
FIG. 2 is a sectional view showing a different operational position of the three-position switching valve in FIG. 1.

When the pilot valve 23*a* is turned on to supply a pilot fluid to the first drive chamber 10*a*, since the first drive chamber 10*a* has a larger diameter than the piston chamber, the working force of the pilot fluid acting on the spool 6 in the first drive chamber 10*a* becomes stronger than the working force of the second piston 13*b* acting on the opposite side of the spool 6. Consequently, the spool 6 moves rightward while moving the second piston 13*b* backward via the linking member 14*b* and switches to a first position at which it abuts on the partition wall 11*b* on the second piston chamber 12*b* side, as shown in FIG. 2. Then, the second piston 13*b* and the linking member 14*b* remain in contact, thereby precluding the urging force of the return spring 18 interposed between them from acting as a reaction force. In addition, the first piston 13*a* abuts the linking member 14*a*, which is engaged with the partition wall 11*a*, to stay at that position together with the member 14*a*.

When the pilot valve 23*a* is turned off to eject the pilot fluid from the first drive chamber 10*a*, the spool 6 is driven leftward by the second piston 13*b* via the linking member 14*b* to return to the neutral position.

When the other pilot valve 23*b* is operated to supply and eject a pilot fluid to and from the second drive chamber 10*b*, the spool 6 is switched between the neutral position and a second switching position at which it abuts the partition wall 11*b* on the first piston chamber 12*a* side.

According to the present three-position switching valve of the above configuration, the spool is held at the neutral position due to the working force of a pilot fluid, so long as a pressure fluid within the working pressure range is being supplied to the switching valve. Accordingly, the spool can be switched only by the working force of the fluid pressure, and is not affected by the reaction force from the return spring, thereby stabilizing the switching operation of the spool and reducing the minimum operating pressure required to increase the working pressure range of the fluid. In addition, the larger working force of the pilot fluid enables the spool to be held at the neutral position reliably and stably.

In addition, while no pressure fluid is being supplied to the switching valve or while a pressure fluid is being supplied below the working pressure, the force of the return spring enables the spool to be held at the neutral position. As a result, the spool can be held reliably at the neutral position regardless of the presence or magnitude of fluid pressure.

What is claimed is:

1. A solenoid-controlled pilot-operated three-position switching valve characterized in that the valve comprises:

multiple ports through which an operating fluid flows;

a valve hole with which each of said ports is in communication;

a spool for switching channels which is slidably accommodated in said valve hole;

two drive chambers that are formed at the respective ends of said valve hole and to and from which a pilot fluid is supplied and ejected;

two piston chambers each formed adjacent to each of said drive chambers so as to be constantly connected to a channel for supplying a pilot fluid, the piston chambers having a smaller diameter than that of said drive chambers;

two pistons each slidably accommodated in each of said piston chambers and urged by a pilot fluid toward the spool;

a linking member interposed between each of said pistons and the spool and cooperating with the piston in holding the spool at a neutral position;

a return spring interposed between said piston and said linking member and effecting an urging force equal to or weaker than the working force of said piston; and two solenoid-controlled pilot valves for supplying and ejecting a pilot fluid to and from the two respective drive chambers.

2. A three-position switching valve according to claim 1 wherein said two drive chambers have the same diameter and wherein said two piston chambers have the same diameter.

3. A three-position switching valve according to claim 1 wherein the switching valve is a five-port valve having one supply port, two output ports, and two ejection ports.

4. A three-position switching valve according to claim 1 wherein each of said drive chambers is formed at each end of the valve hole so as to be faced by the end surface of the spool acting as a pressure-receiving surface, each of said piston chambers being formed outside the drive chamber via a partition wall acting like a cushion, said linking member being disposed to penetrate the partition wall in such a way that its ends protrude into the piston and drive chambers, respectively, a flange section being formed at the piston-chamber-side end of the linking member in such a way as to abut the partition wall, so that when the linking member is pressed by the piston, the flange section abuts partition wall to hold the spool at the neutral position.

5. A three-position switching valve according to claim 4 wherein a guide shaft and a guide hole that are fitted together are provided in said piston and linking member, respectively, as a guide means for stabilizing the piston's sliding activity.

6. A three-position switching valve according to claim 1 wherein a valve body of the switching valve has an external pilot port for introducing an exclusive pilot fluid into a valve body from the exterior and a pilot channel switching means for selectively connecting said drive and piston chambers the external pilot port or a supply port.

7. A three-position switching valve according to claim 6 wherein said pilot channel switching means includes a switching plate mounted on a mounting surface of the valve body so as to have its direction changed, three channels opened in said mounting surface in a row, and a dent formed in said switching plate to selectively connect the middle channel to one of the two side channels when the direction of the switching plate is changed and wherein the middle channel acts as a pilot supply channel leading to said drive and piston chambers, while one of the side channels acts as an internal pilot channel leading to the supply port, and the other acts as an external pilot channel leading to the external pilot port.

* * * * *